United States Patent [19]

Barwick, III et al.

[11] Patent Number: 4,661,116

[45] **Date of Patent: * Apr. 28, 1987**

[54] CONTINUOUS DYEING OF CATIONIC DYEABLE POLYESTER FIBERS

[75] Inventors: Frederick E. Barwick, III, Roxboro; Kyle R. Pearce, Hillsborough, both of N.C.

[73] Assignee: Collins & Aikman Corporation, New York, N.Y.

[ * ] Notice: The portion of the term of this patent subsequent to Apr. 14, 2004 has been disclaimed.

[21] Appl. No.: 696,926

[22] Filed: Jan. 31, 1985

[51] Int. Cl.[4] ..... D06P 1/62; D06P 3/54; D06P 5/20

[52] U.S. Cl. ..... 8/532; 8/529; 8/539; 8/603; 8/654; 8/657; 8/922; 8/613; 8/614

[58] Field of Search ..... 8/539, 532, 614, 603

[56] References Cited

U.S. PATENT DOCUMENTS

| | | | |
|---|---|---|---|
| 4,441,885 | 4/1984 | Abel et al. | 8/603 |
| 4,453,946 | 6/1984 | Abel et al. | 8/603 |

FOREIGN PATENT DOCUMENTS

| | | |
|---|---|---|
| 3414306 | 10/1985 | Fed. Rep. of Germany . |
| 52-103574 | 8/1977 | Japan . |
| 53-081775 | 7/1978 | Japan . |
| 1406803 | 9/1975 | United Kingdom . |

*Primary Examiner*—A Lionel Clingman

*Attorney, Agent, or Firm*—Bell, Seltzer, Park & Gibson

[57] ABSTRACT

Textile fabrics formed at least partially of cationic dyeable polyester fibers are dyed in a continuous process with an aqueous dyebath comprising (a) 0 to 5 g/l of thickener;

(b) cationic dyestuffs in an amount sufficient to dye the cationic dyeable polyester fibers to the desired depth of color;

(c) 2 to 100 g/l of a partially sulfated adduct of ethylene oxide with an alkyl phenol or $C_8$ to $C_{16}$ fatty alcohols;

(d) 2 to 60 g/l of nonionic or anionic surfactants; and (e) 5 to 50 g/l of at least one organic compound selected from the group consisting of aromatic nitrile ethers and ethoxylated chlorophenols.

The fabrics are continuously dyed by padding, immersing, spraying or otherwise applying the dyestuffs, steaming the fabrics in their wet condition, and subsequently washing and drying.

12 Claims, No Drawings

CONTINUOUS DYEING OF CATIONIC DYEABLE POLYESTER FIBERS

BACKGROUND OF THE INVENTION

This invention relates to the dyeing of textile fibers, and in particular to a continuous process for dyeing textile fabrics formed at least partially of cationic dyeable polyester fibers.

Cationic dyeable polyester has become increasingly popular in recent years as a textile fiber, primarily because cationic dyes are capable of producing brighter shades than regular (disperse) dyeable polyester. In practice, the cationic dyeable polyester is frequently combined with other fibers, such as regular (disperse) dyeable polyester, wool, or cellulosic fibers, to produce various multicolor or cross-dyed effects. It is also known to use cationic dyeable polyester in combination with other fibers which are unaffected by cationic dyes to thereby achieve color/white effects.

Insofar as applicants are aware, the dyeing of cationic dyeable polyester fibers has been restricted to batch methods, normally at intermediate temperatures of up to about 105 to 115 degrees C. High temperature processes, such as the Thermosol process, are not suitable for cationic dyeable polyester because the high temperatures destroy the dye sites. Moreover, because the relative dyeing speed of cationic dyeable polyester is considerably lower than that of other conventional fibers, it has been thought important to allow time for diffusion of the dyes into the fibers after they have been exhausted from the dyebath, and this is best accomplished only in batch dyeing methods.

It is therefore an object of the present invention to provide a method for continuously dyeing cationic dyeable polyester fibers or blends of cationic dyeable polyester with other fibers such as regular dyeable polyester.

In commonly-assigned U.S. Pat. application Ser. No. 653,941 filed Sept. 20, 1984 entitled METHOD FOR DYEING POLYESTER FABRICS, a process is disclosed in which fabrics containing regular (disperse) dyeable polyester fibers can be continuously dyed. This process involves impregnating the fabrics with an aqueous dyebath containing (a) 0 to 5.0 g/l of a thickener;

(b) commercially available disperse dyestuffs in an amount sufficient to dye the fibers to the desired depth of color;

(c) 2 to 100 g/l of a partially sulfated adduct of ethylene oxide with alkylphenol or $C_8$ to $C_{16}$ fatty alcohols;

(d) 0 to 60 g/l of nonionic or anionic surfactants; and (e) 5 to 50 g/l of at least one organic compound selected from the group consisting of aromatic nitrile ethers and ethoxylated chlorophenols.

Although cationic dyeable polyester fibers behave quite differently from disperse dyeable polyester fibers, and are normally dyed by processes which are fundamentally different from the processes used for disperse dyeable polyester, it has been discovered in accordance with the present invention that a dyebath composition similar to that noted above can be successfully employed for continuously dyeing cationic dyeable polyester fibers, which, as earlier noted, have not heretofore been dyed in a continuous process.

SUMMARY OF THE INVENTION

In accordance with the present invention, cationic dyeable polyester fibers are dyed in a continuous process comprising the following steps:

(1) continuously advancing cationic dyeable polyester fibers in continuous length form, such as yarns or fabrics formed therefrom, through a dyestuffs applicator;

(2) impregnating the fibers in the dyestuffs applicator with an aqueous dyebath comprising (a) 0 to 5 g/l of a thickener (b) cationic dyestuffs in an amount sufficient to dye the cationic dyeable polyester fibers to the desired depth of shade (c) 2 to 100 g/l of a partially sulfated adduct of ethylene oxide with alkylphenol or $C_8$ to $C_{16}$ fatty alcohols (d) 2 to 60 g/l of nonionic or anionic surfactants, and (e) 5 to 50 g/l of at least one organic compound selected from the group consisting of aromatic nitrile ethers and ethoxylated chlorophenols;

(3) continuously directing the fibers from the dyestuffs applicator to and through a heating chamber and heating the fabric to a temperature and for a time sufficient to fix the dyestuffs; and (4) washing and drying the thus dyed fibers.

DETAILED DESCRIPTION OF THE INVENTION

The method of the present invention is especially applicable to the dyeing of textile fabrics of various types and constructions, including woven, knitted and nonwoven fabrics, flat fabrics, and pile fabrics such as velvets, plushes, and velours. The fabric may be formed solely of cationic dyeable polyester fibers, or may comprise blends or mixtures of cationic dyeable polyester fibers with other fibers such as regular (disperse) dyeable polyester fibers, and cellulosic fibers, including both cellulosic fibers of natural origin, such as cotton or linen, as well as synthetic or regenerated cellulosic fibers such as rayon, viscose, or cellulose diacetate or triacetate. Various styling effects can be achieved using blends or mixtures of the cationic dyeable polyester fibers with other fibers. If desired, however, the present invention may also be employed, for continuously dyeing cationic dyeable polyester fibers in continuous length forms other than fabrics, such as yarns for example.

Of particular importance for the invention is the composition of the dyebath. The individual operations for the application of the dyebath, such as immersion, padding, spraying, scraping on, application of foam, impregnation, etc. and the subsequent treatments, such as steaming, washing, and drying are per se conventional steps and employ known types of apparatus.

According to the invention, the textile fabrics are impregnated in an aqueous dyebath by suitable application methods, such as immersion, padding, spraying, scraping on, or by the application of foam, up to a weight increase (wet pickup) of 60 to 250%, preferably 80 to 200%, and, in particular, 80 to 160%, then directly steamed in their wet condition for 1 to 20 minutes, at 96°-105° C., preferably 98°-102° C., then again washed several times at 20 to 60° C., mechanically drained and finally dried at 140 to 210° C., preferably 170 to 200° C., for 1 to 10 minutes, preferably 2 to 8 minutes, and in particular 2 to 6 minutes.

The impregnation bath comprises:

(a) 0 to 5 g/l of a thickener;

(b) commercially available cationic (basic) dyestuffs;

(c) 2 to 100 g/l of a partially sulfated adduct of ethylene oxide with an alkyl phenol or $C_8$ to $C_{16}$ fatty alcohols;

(d) 2 to 60 g/l nonionic or anionic surfactants; and (e) 5 to 50 g/l of at least one organic compound selected from the group consisting of aromatic nitrile ethers or ethoxylated chlorophenols.

Suitable thickeners may include nonionic and/or anionic products as can be derived from the addition of ethylene oxide, from the oxidative or thermal decomposition or, respectively, carboxymethylation of guar or locust bean powder; or cellulose, starch or algin derivatives. Suitable thickeners include carboxymethylcellulose, carboxymethylstarch, alginates, such as the sodium, potassium or ammonium salts of algin. Particularly suitable are products derived from the addition of ethylene oxide as well as products with a 0.3 to 0.7 degree of substitution.

The method of the present invention may employ any of the usual commercially available cationic (basic) dyestuffs generally recognized as suitable for use on cationic dyeable polyester. They may be used both as dispersed powders and aqueous dispersions. One example of suitable cationic dyestuffs are the ASTRAZON cationic dyes available from Mobay Chemical Corporation, Dyestuff Division, Union, N.J. (ASTRAZON is a registered trademark of Mobay Chemical Corporation).

When dyeing blends or mixtures of cationic dyeable polyester with regular (disperse) dyeable polyester, then commercially available disperse dyestuffs may also be included in the dyebath in the usual amounts for dyeing the disperse dyeable polyester fibers.

Likewise, when cellulosic fibers are present in the fabric, the usual commercially available direct dyestuffs conventionally used for cellulosic fibers may be employed in this process They are water soluble and can belong to the various chemical classes of dyestuffs, such as, for example, azo dyestuffs, anthraquinone dyestuffs or metallized dyestuffs. The dyestuffs particularly suitable for the method of the present invention, are selected by their solubility, high color absorption and high lightfastness. Both the disperse and direct dyestuffs may contain the usual dispersing and pulverizing assistants as well as diluent substances or salts.

Also of importance for the present method is the use of partially sulfated adducts of ethylene oxide with alkylphenols or $C_8$ to $C_{16}$ fatty alcohols, identified above as component (c). Preferred are partially sulfated adducts of nonylphenol or $C_{12}$ fatty alcohols with 1 to 6 mols ethylene oxide. Specific examples include: the ammonium salt of a partially sulfated adduct of nonylphenol with 5.5 mols ethylene oxide, the sodium salt of a partially sulfated adduct of nonylphenol with 4 mols ethylene oxide, the sodium salt of a partially sulfated adduct of a $C_{12}$ fatty alcohol with 2 mols ethylene oxide, the ammonium salt of a partially sulfated adduct of nonylphenol with 2.5 mols ethylene oxide, and the ammonium salt of a partially sulfated adduct of octylphenol with 6 mols ethylene oxide.

These products are obtained by the partial sulfation of the adducts from ethylene oxide with alkyl phenols or fatty alcohols respectively. The degree of the ethoxylation and sulfation may widely vary, and the products are obtained in the form of their ammonium or alkali, in particular sodium, salts. This component acts as an emulsifier and dispersant for the dyes and can be directly added to the dyebath.

The dyebath also desirably includes anionic and nonionic surfactants, identified above as component (d). Suitable surfactants may be selected from ammonium or alkali metal salts of alkane sulfonates, sulfonated carboxylic acid esters, or sulfonated carboxylic acid amides. Preferred are $C_{12}$ to $C_{14}$ alkane monosulfonates or sodium dioctylsulfosuccinate. Specific examples include: the sodium salt of sulfosuccinic acid 2-ethylhexylester, the sodium salt of $C_{12}$ to $C_{16}$ alkanesulfonate, and the sodium salt of sulfosuccinic acid $C_{12}$ hemi-amide.

These, in general, are wetting agents which are known to the person skilled in the art under the description of rapid wetting agents. In the method of this invention, these agents serve as wetting agents during the application stage and also serve to generate foam in the steaming stage to promote level and even dyeing, especially of pile fabrics. Chemically, they are $C_{12}$ to $C_{16}$ alkane sulfonates, monoesters and diesters of sulfosuccinic acid, or monoamides or diamides of sulfosuccinic acid. The component (d) can be directly added to the dyebath. Also suitable are ammonium or alkali metal salts of alkylarylsulfonates, such as sodium dodecyl benzenesulfonate; ammonium or alkali metal salts of lauryl sulfonate, such as sodium lauryl sulfonate; ammonium or alkali metal salts of ethylene oxide adducts of lauryl sulfonate, such as the sodium salt of the addition of 1 to 6 mols of ethylene oxide to lauryl sulfonate; and ammonium or alkali metal salts of ethylene oxide adducts of $C_{12}$ to $C_{25}$ fatty acids, an example of which is the adduct of 9 to 50 mols of ethylene oxide to octadecanoic acid.

Component (e) as described above may comprise accelerators based on aromatic nitrile ethers or ethoxylated chlorophenols in emulsified form, in particular, benzyloxypropionitrile, chlorobenzyloxypropionitrile and methylbenzyloxypropionitrile, as well as di-and triethylene glycol ether. Preferably the nitrile ethers have a molecular weight of 100 to 250, in particular, 150 to 200, and that of the ethoxylated chlorophenols ranges from 150 to 400, in particular from 200 to 300.

These products are water insoluble, high-boiling liquids, which are capable of softening the polyester fibers under the conditions of the method according to the invention. Therefore, they make possible and accelerate the diffusion of the disperse dyes into the polyester fibers.

Commercially available products of component (e) are either pure substances or contain emulsifiers. Pure substances are added with the aforesaid assistants to the padding liquors in emulsified form. Particularly suitable components (e) for the present method are di- and triethyleneglycol monochlorophenyl ethers and benzyloxypropionitrile. Preferred emulsifiers for the component (e) are ethoxylated $C_{16}$ to $C_{18}$ fatty alcohols with 10 to 25 mols ethylene oxide.

The described assistants (c), (d), and (e) can be used both alone and combined with each other, and the sum of the quantities used can vary from about 2 to about 200 g/l of the dyebath.

Preferably, the dyebath should also contain Glauber's salt to insure maximum contrast and maximum dye yield. The Glauber's salt may be suitably employed at a rate of 0.25 to 20 g/l Aside from the aforesaid ingredients, the dyebath may contain additional assistants, such as dispersing agents, wetting agents, antistatic agents, flame retardants, lightfastness enhancers and defoamers.

The following examples are intended to describe the invention in more detail, but not to limit it.

EXAMPLE 1

A Raschel plush of alternating yarns of homopolymer polyester and Dupont Dacron 92 copolymer polyester (a polymer which has been rendered substantive to cationic dyestuffs) was preset at 200 degrees C. for 60 seconds. The fabric was then impregnated by padding with a liquor consisting of:

1 g/l Locust Bean Powder
1.25 g/l Eastman Polyester Blue GLF (Trade Name)
3.15 g/l Foron Yellow Brown S2RFL (Trade Name)
0.675 g/l Palanil Pink REL (Trade Name)
1.32 g/l Basacryl Yellow 5RL (Trade Name)
0.085 g/l Astrazon Red FBL 180% (Trade Name)
0.6 g/l Sevron Blue BGLN (Trade Name)
50 g/l Sodium Salt of a partially sulfonated adduct of Nonylphenol W/4 Mols Ethylene Oxide
3 g/l Glauber Salt
3 g/l Sodium Salt of Sulfosuccinic Acid 2 -Ethylhexylester
10 g/l Barflame OTF New (Trade Name) flame retardant
20 g/l TINUVIN 326 (Trade Name) Lightfastness enhancer
20 g/l Benzyloxypropionitrile The absorption of the bath amounts to 92%. The fabric was then steamed for 15 minutes at 98 degrees C. in saturated vapor atmosphere and then washed three times in 50 degree C. water, mechanically extracted to 80% residual moisture and dried for three minutes on a tenter at 180 degrees C. The result was a striped fabric having the copolymer yarn a Medium Brown and the homopolymer yarn a Light Tan, each of uniform coloration and good general fastness.

EXAMPLE 2

A woven plush of alternating yarns of homopolymer polyester and copolymer polyester (a polymer which has been rendered substantive to cationic dyestuffs) was preset at 180 degrees C. for 90 seconds. The fabric was then impregnated by padding with a liquor consisting of:

3 g/l Locust Bean P0wder
4.25 g/l Eastman P0lyester Blue GLF (Trade Name)
15.5 g/l Foron Yellow Brown S2RFL (Trade Name)
5 g/l Sodyecron Red CRL (Trade Name)
60 g/l P0tassium Salt of a partially sulfonated adduct of Nonylphenol W/4 Mols Ethylene Oxide
6 g/l Sodium Sulfate
10 g/l Sodium Salt of Sulfosuccinic Acid 2 -Ethylhexylester
10 g/l Barflame OTF New (Trade Name) flame retardant
20 g/l TINUVIN 326 (Trade Name) lightfastness enhancer
20 g/l Benzyloxypropionitrile The absorption of the bath amounts to 92%. The fabric was then steamed for 10 minutes at 98 degrees C. in saturated vapor atmosphere and then washed three times in 40 degree C. water, mechanically extracted to 80% residual moisture and dried for three minutes on a tenter at 190 degrees C. The result was a tone on tone striped fabric having the copolymer yarn of darker cast than the homopolymer yarn, each of uniform coloration and good general fastness.

EXAMPLE 3

A Raschel plush of alternating yarns of homopolymer polyester and copolymer polyester (a polymer which has been rendered substantive to cationic dyestuffs) was preset at 200 degrees C. for 60 seconds. The fabric was then impregnated by padding with a liquor consisting of:

2 g/l Locust Bean P0wder
1.5 g/l Basacryl Violet FL (Trade Name)
0.5 g/l Astrazon Red FBL 180% (Trade Name)
0.5 g/l Remacryl Blue BRL-300 (Trade Name)
60 g/l P0tassium Salt of a partially sulfonated adduct of Nonylphenol W/4 Mols Ethylene Oxide
4 g/l Glauber Salt
20 g/l Sodium Salt of Sulfosuccinic Acid 2 -Ethylhexylester
30 g/l Benzyloxypropionitrile The absorption of the bath amounts to 92%. The fabric was then steamed for 12 minutes at 99 degrees C. in saturated vapor atmosphere and then washed three times in 60 degree C. water, mechanically extracted to 80% residual moisture and dried for three minutes on a tenter at 175 degrees C. The result was uniform violet coloration of the yarn identified as copolymer and the homopolymer yarn was void of coloration. The fabric had good general fastness.

EXAMPLE 4

A woven pile fabric of alternating yarns of homopolymer polyester and copolymer polyester (a polymer which has been rendered substantive to cationic dyestuffs) and a 100% cotton warp was preset at 200 degrees C. for 45 seconds. The fabric was then impregnated by padding with a liquor consisting of:

1 g/l Locust Bean P0wder
1.25 g/l Eastman P0lyester Blue GLF (Trade Name)
3.15 g/l Foron Yellow Brown S2RFL (Trade Name)
0.675 g/l Palanil Pink REL (Trade Name)
1.32 g/l Basacryl Yellow 5RL (Trade Name)
0.085 g/l Astrazon Red FBL 180% (Trade Name)
0.6 g/l Sevron Blue BGLN (Trade Name)
10.1 g/l Superlitefast Orange LLLWF 200% (Trade Name)
2.5 g/l Pyrazol Blue FGL 200% (Trade Name)
15.4 g/l Solophenyl Red 3BL (Trade Name)
50 g/l Sodium Salt of a partially sulfonated adduct of Nonylphenol W/4 Mols Ethylene Oxide
3. g/l Glauber Salt
3 g/l Sodium Salt of Sulfosuccinic Acid 2 -Ethylhexylester
10 g/l Barflame OTF New (Trade Name) flame retardant
20 g/l TINUVIN 326 (Trade Name) lightfastness enhancer
20 g/l Benzyloxypropionitrile The absorption of the bath amounts to 110%. The fabric was then steamed for 15 minutes at 98 degrees C. in saturated vapor atmosphere and then washed three times in 45 degree C. water with 2.50% g/l of Raycafix CAJ in the final rinse, mechanically extracted to 80% residual moisture and dried for three minutes on a tenter at 185 degrees C. The result was a striped fabric having the yarn identified as copolymer a Medium Brown, the homopolymer yarn a Light Tan and the backing a Dark Brown, each of uniform coloration and good general fastness.

EXAMPLE 5:

A Tricot Knit consisting of 100% copolymer polyester (A polymer which has been rendered substantive to cationic dyestuffs) was preset at 188 degrees C. for 75 seconds. The fabric was then impregnated by padding with a liquor consisting of:

1 g/l Locust Bean P0wder
1.32 g/l Basacryl Blue X7GFL (Trade Name)
1 g/l Astrazon Blue 9GL (Trade Name)
2.2 g/l Sevron Yellow 8GMF (Trade Name)
55 g/l Sodium Salt of a partially sulfonated adduct of Nonylphenol W/4 Mols Ethylene Oxide
3 g/l Glauber Salt
10 g/l Sodium Salt of Sulfosuccinic Acid 2 Ethylhexylester
10 g/l Barflame OTF New (Trade Name)
30 g/l Benzyloxypropionitrile The absorption of the bath amounts to 85%. The fabric was then steamed for 15 minutes at 98 degrees C. in saturated vapor atmosphere and then washed three times in 50 degree C. water, mechanically extracted to 80% residual moisture and dried for two minutes on a tenter at 180 degrees C. The result was fabric having a uniform bright green coloration and good general fastness.

That which is claimed:

1. A method of continuously dyeing textile fabrics comprising (1) continuously advancing through a pad bath, a fabric formed both of cationic dyeable polyester fibers and of at least one additional fiber selected from the group consisting of disperse dyeable polyester fibers and cellulosic fibers;

(2) impregnating the fabric in the pad bath with an aqueous dyebath comprising (a) 0 to 5 g/l of a thickener (b) cationic dyestuffs in an amount sufficient to dye the cationic dyeable polyester fibers to the desired depth of shade (c) at least one additional dyestuff in an amount sufficient to dye said at least one additional fiber to the desired depth of shade, said at least one additional dyestuff being substantive toward said at least one additional fiber (d) 2 to 100 g/l of a partially sulfated adduct of ethylene oxide with an alkyl phenol or $C_8$ to $C_{16}$ fatty alcohols (e) 2 to 60 g/l of nonionic or anionic surfactants, and (f) 5 to 50 g/l of at least one organic compound selected from the group consisting of aromatic nitrile ethers and ethoxylated chlorophenols;

(3) continuously directing the fabric from the pad bath to and through a heating chamber and heating the fabric to a temperature and for a time sufficient to fix the dyestuffs; and (4) washing and drying the thus dyed fabric.

2. A method according to claim 1 wherein the fabrics are impregnated with said aqueous dyebath to a wet pick-up of 60 to 250 percent.

3. A method according to claim 1 wherein the heating of the impregnated fibers to fix the dyestuffs comprises steaming for 1 to 20 minutes at 96° to 105° C.

4. A method according to claim 1 wherein said aqueous dyebath additionally includes auxiliary agents such as dispersing agents, wetting agents, antistatic agents and defoamers.

5. A method according to claim 1 wherein said aqueous dyebath additionally includes Glauber's salt.

6. A method of continuously dyeing textile fabrics comprising (1) continuously advancing a fabric formed both of cationic dyeable polyester fibers and of disperse dyeable polyester fibers through a pad bath;

(2) impregnating the fabric in the pad bath with an aqueous dyebath comprising (a) 0 to 5 g/l of a thickener (b) cationic dyestuffs in an amount sufficient to dye the cationic dyeable polyester fibers to the desired depth of shade (c) disperse dyestuffs in an amount sufficient to dye the disperse dyeable polyester fibers to the desired depth of shade (d) 2 to 100 g/l of a partially sulfated adduct of ethylene oxide with an alkyl phenol or $C_8$ to $C_{16}$ fatty alcohols (e) 2 to 60 g/l of nonionic or anionic surfactants, and (f) 5 to 50 g/l of at least one organic compound selected from the group consisting of aromatic nitrile ethers and ethoxylated chlorophenols;

(3) continuously directing the fabric from the pad bath to and through a continuous steamer for from 1 to 20 minutes at 96 to 105° C. and steaming the fabric to fix the dyestuffs; and (4) continuously directing the fabric from the steamer successively through a washer and dryer.

7. A method of continuously dyeing textile fabrics comprising (1) continuously advancing a fabric formed both of cationic dyeable polyester fibers and of cellulosic fibers through a pad bath;

(2) impregnating the fabric in the pad bath with an aqueous dyebath comprising (a) 0 to 5 g/l of a thickener (b) cationic dyestuffs in an amount sufficient to dye the cationic dyeable polyester fibers to the desired depth of shade (c) direct dyestuffs in an amount sufficient to dye the cellulosic fibers to the desired depth of shade (d) 2 to 100 g/l of a partially sulfated adduct of ethylene oxide with an alkyl phenol or $C_8$ to $C_{16}$ fatty alcohols (e) 2 to 60 g/l of nonionic or anionic surfactants, and (f) 5 to 50 g/l of at least one organic compound selected from the group consisting of aromatic nitrile ethers and ethoxylated chlorophenols;

(3) continuously directing the fabric from the pad bath to and through a continuous steamer for from 1 to 20 minutes at 96° to 105° C. and steaming the fabric to fix the dyestuffs; and (4) continuously directing the fabric from the steamer successively through a washer and dryer.

8. A method according to claim 7 wherein the fabric also contains disperse dyeable polyester fibers, and wherein said aqueous dyebath also includes disperse dyestuffs in an amount sufficient to dye the disperse dyeable polyester fibers to the desired depth of shade.

9. A dyed textile fabric produced by the process of claim 1.

10. A dyed textile fabric produced by the process of claim 6.

11. A dyed textile fabric produced by the process of claim 7.

12. A dyed textile fabric produced by the process of claim 8.

* * * * *